US007491040B2

(12) United States Patent
McCombs et al.

(10) Patent No.: US 7,491,040 B2
(45) Date of Patent: Feb. 17, 2009

(54) COMPACT COMPRESSOR

(75) Inventors: Norman R. McCombs, Tonawanda, NY (US); Robert E. Casey, Buffalo, NY (US); Robert Bosinski, West Seneca, NY (US)

(73) Assignee: AirSep Corporation, Buffalo, NY (US)

( * ) Notice: Subject to any disclaimer, the term of this patent is extended or adjusted under 35 U.S.C. 154(b) by 491 days.

(21) Appl. No.: 10/932,183

(22) Filed: Sep. 1, 2004

(65) Prior Publication Data

US 2005/0047947 A1 Mar. 3, 2005

Related U.S. Application Data

(60) Provisional application No. 60/499,500, filed on Sep. 2, 2003.

(51) Int. Cl.
*F04B 39/00* (2006.01)
*F04B 39/10* (2006.01)
*F04B 53/12* (2006.01)

(52) U.S. Cl. ..... 417/545; 417/312; 417/546; 417/550

(58) Field of Classification Search ..... 417/545, 417/550, 546
See application file for complete search history.

(56) References Cited

U.S. PATENT DOCUMENTS

| | | | | | |
|---|---|---|---|---|---|
| 2,779,295 | A * | 1/1957 | Manning | 417/546 |
| 3,645,651 | A * | 2/1972 | Bills | 417/479 |
| 5,152,713 | A * | 10/1992 | Baertlein | 452/64 |
| 5,489,197 | A * | 2/1996 | Tsai | 417/526 |
| 6,149,402 | A * | 11/2000 | Kim | 417/312 |
| 6,283,720 | B1 * | 9/2001 | Kottke | 417/53 |
| 6,692,240 | B1 * | 2/2004 | Leonhard et al. | 417/372 |
| 2004/0131489 | A1 * | 7/2004 | Leu et al. | 417/569 |

* cited by examiner

*Primary Examiner*—Devon C Kramer
*Assistant Examiner*—Philip Stimpert
(74) *Attorney, Agent, or Firm*—Ronald S. Kareken; Hiscock & Barclay, LLP

(57) ABSTRACT

A compact compressor including one or more heads. Each of the compressor heads is configured with at least one of the intake and output valves incorporated into the piston head. The compact compressor also has a cylinder with a reduced mass, increased surface area, and metal to metal contact with the housing for greater dissipation of heat generated by the compressor.

11 Claims, 16 Drawing Sheets

Fig. 11c
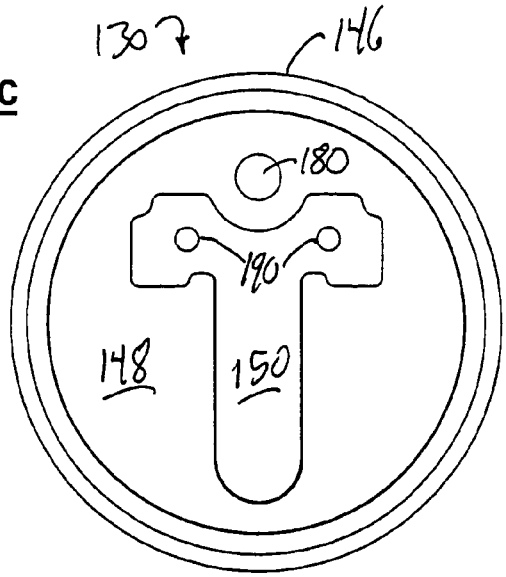
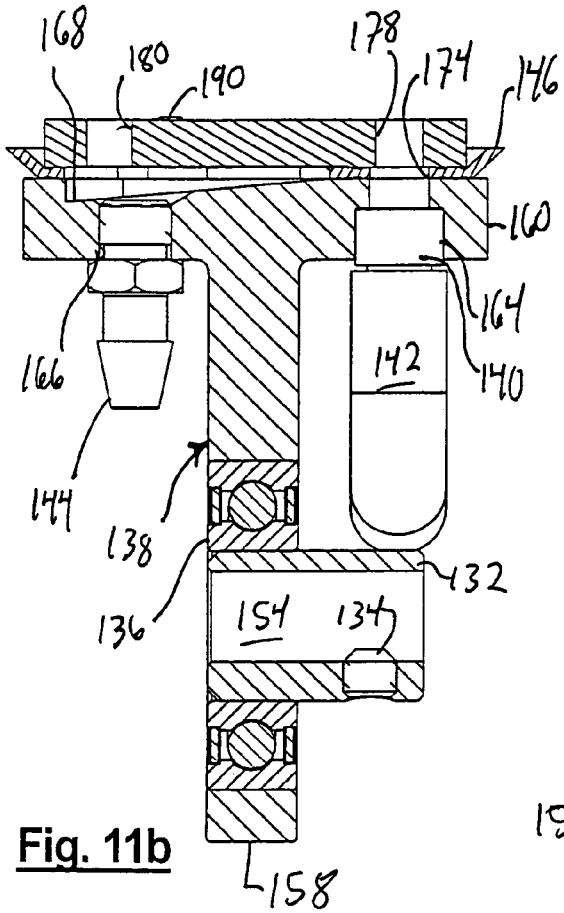
Fig. 11b
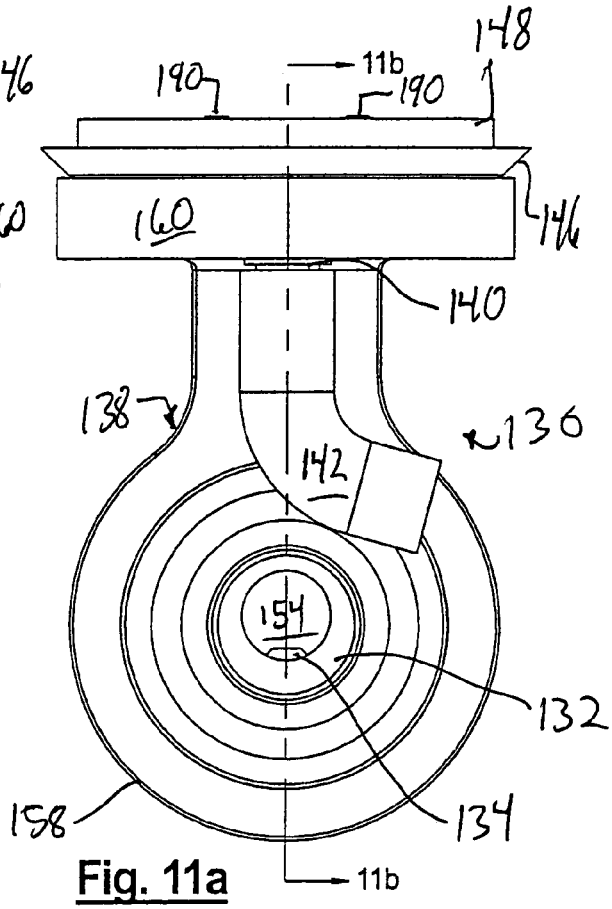
Fig. 11a

COMPACT COMPRESSOR

CROSS-REFERENCE TO RELATED APPLICATIONS

This application claims priority from Provisional Patent Application Ser. No. 60/499,500, filed Sep. 2, 2003.

FIELD OF THE INVENTION

This invention relates to gas compressors, especially those used in compact, portable oxygen concentrators.

BACKGROUND OF THE INVENTION

Conventional gas compressors have valves incorporated into one end of a compression cylinder. The mass of the valve block impedes transfer of heat generated by the compressor, and rubber seals between the valve block and the cylinder further prevent heat dissipation in the compressor. Unless sufficiently dissipated, the heat generated by the compressor will reduce the life of the seals used to create a seal between the piston head and the cylinder. Conventionally, heat dissipation is achieved by increasing the size of the piston head. However, because larger piston heads tend to create excessive vibration and noise, a compact compressor having increased heat dissipation is desired in the art.

SUMMARY OF THE INVENTION

The invention comprises, in one form thereof, a compact compressor having the intake and output valves incorporated into the piston head. This configuration is compact and also allows the full surface of the compression cylinder to be used for heat dissipation. The simplified cylinder has less mass, greater surface area, and metal to metal contact with the housing for greater dissipation of heat generated by the compressor thereby prolonging the life of the compressor.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein:

FIG. 11*a*-11*c* are views of the piston assembly of FIG. 6;

Corresponding reference characters indicate corresponding parts throughout the several views. The exemplification set out herein illustrate the preferred embodiment of the invention and such exemplification is not to be construed as limiting the scope of the invention in any manner.

DETAILED DESCRIPTION

Figure 1A:
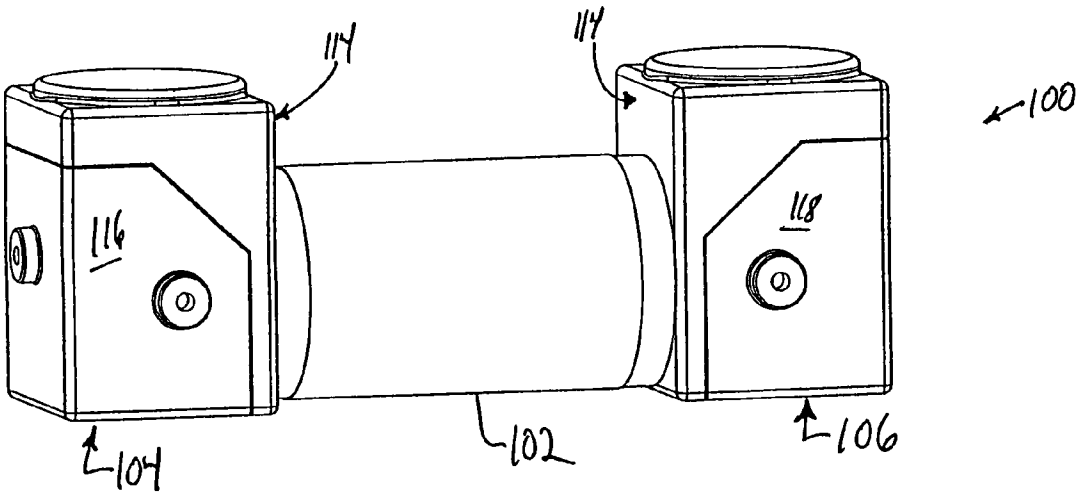
FIGS. 1*a* and *b* are isometric views of a first embodiment of a double-headed compressor of the present invention.
Figure 1B:
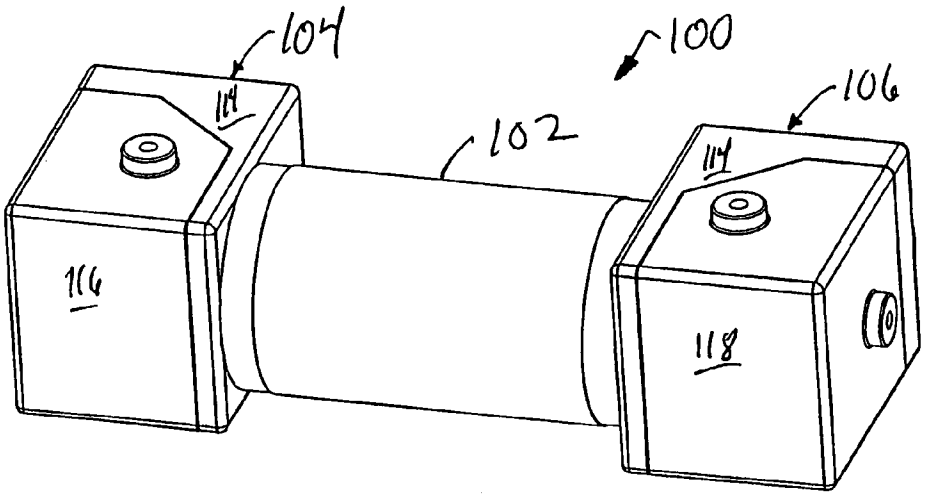

Referring to FIGS. 1*a* and 1*b*, there is shown the compact dual head air compressor of the present invention. The dual head compressor 100 includes a motor 102, a first compressor head 104, and a second compressor head 106.

Figure 2:
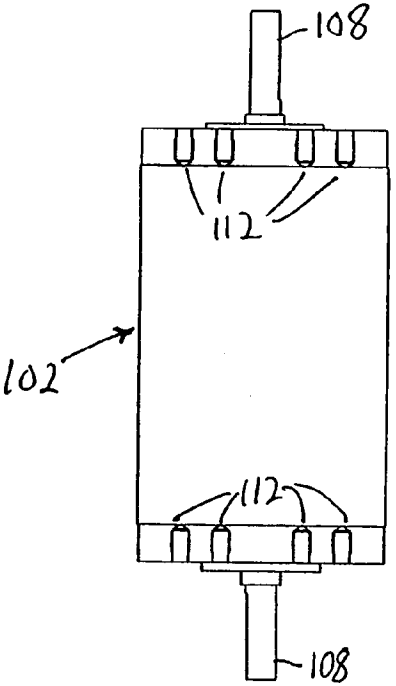
FIG. 2 is a top view of the motor of the compressor of FIG. 1*a;*

Referring to FIG. 2, the motor 102 is shown. The motor 102 is preferably a standard electric motor having a drive shafts 108 on each of two opposing ends of the motor 102. The motor 102 further includes a plurality of tapped blind bores 112 arranged in circles that are concentric with each drive shaft 108.

Figure 3A:
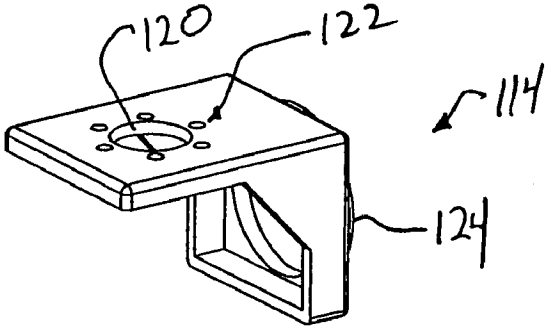
FIGS. 3*a* and 3*b* are isometric views of the compressor housing covers of FIG. 1*a;*
Figure 4:
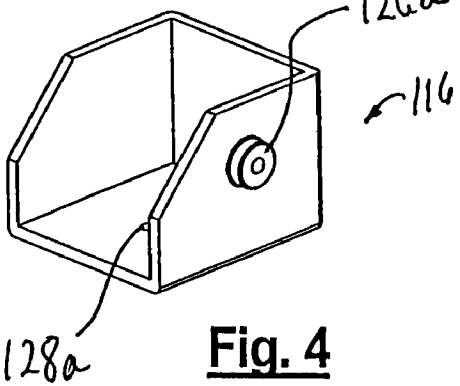
FIGS. 4 and 5 are isometric views of the right and left compressor housings of FIG. 1*a;*
Figure 3B:
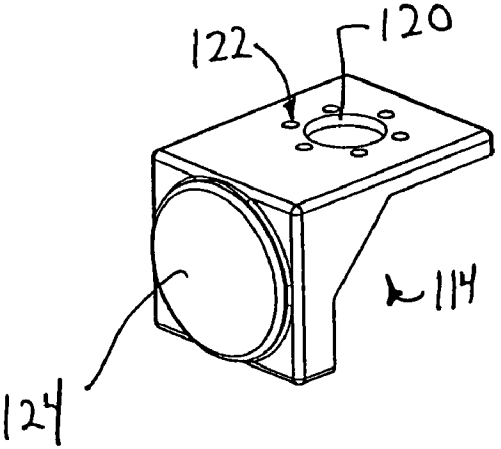
Figure 5:
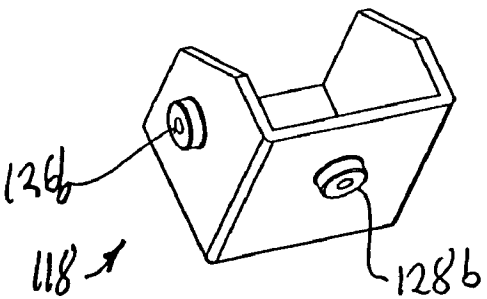

Referring again to FIG. 1*a*, each of the first compressor head 104 and second compressor head 106 includes a compressor housing cover 114 and compressor housings 116 and 118. The compressor housing cover 114 is shown in FIGS. 3*a* and 3*b* and includes a drive shaft receptacle 120, a plurality of through holes 122 substantially concentric with the drive shaft receptacle 120, and a compressor cylinder 124. The drive shaft receptacle 120 is a through hole having a clearance fit with the corresponding drive shaft 108. The through holes 122 are configured for lining up with the tapped blind bores 112 of one end of the motor 102. The compressor cylinder 124 has an axis that is substantially perpendicular to the axis of the drive shaft receptacle 120. The compressor housing 116 is shown in FIG. 4 and includes an intake port 126*a* and a output port 128*a*. As shown in FIG. 5 the second compressor housing 118 is the mirror image of the compressor housing 116 and includes an intake port 126*b* and a output port 128*b*. Each of the compressor housings 116 and 118 is configured to engage a compressor housing cover 114 to form a completely enclosed housing for each of the compressor heads. The compressor housings 116 and 118 are made of a rigid, heat conducting material such as aluminum.

Figure 6:
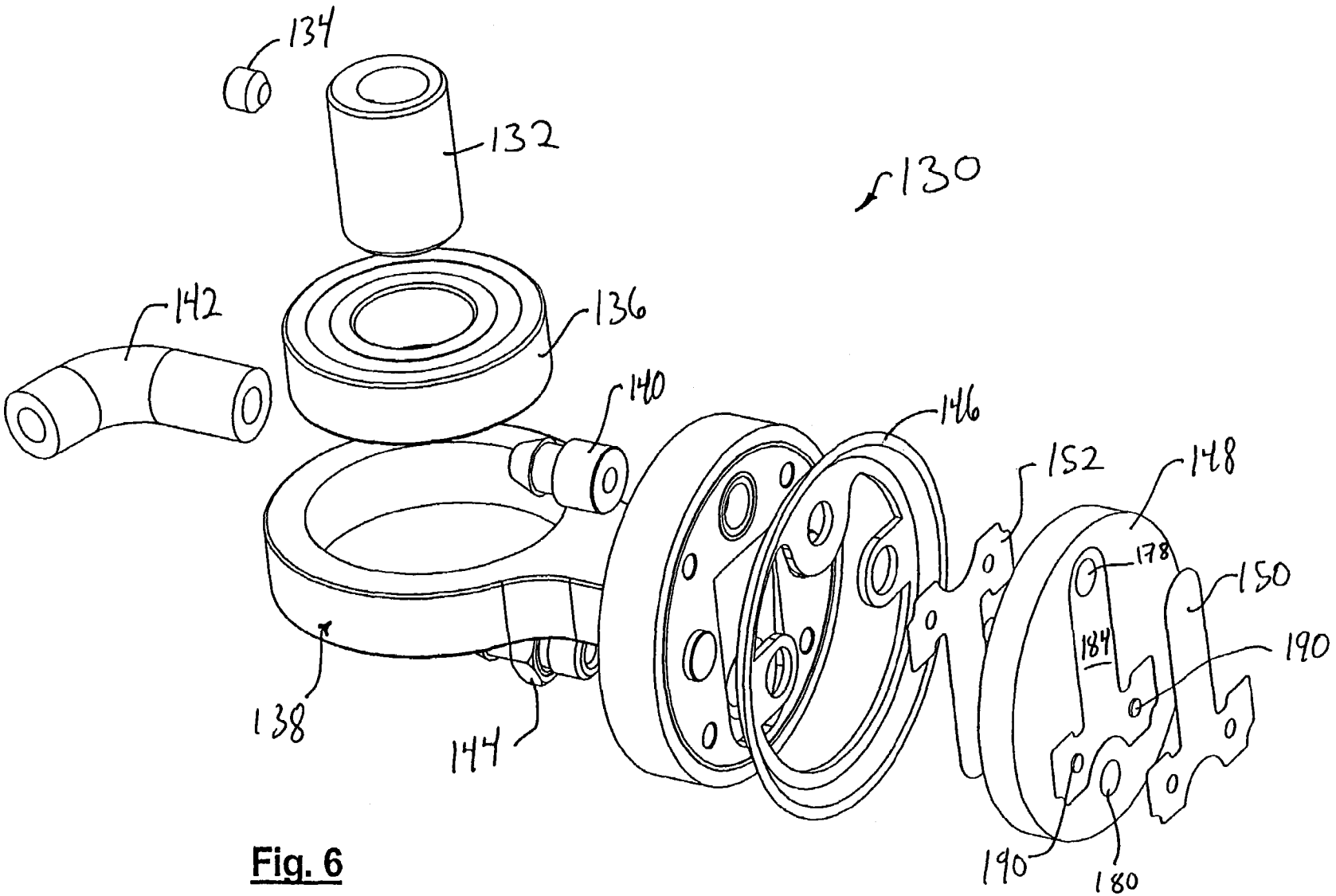
FIG. 6 is an exploded view of the piston components of the compressor of FIG. 1*a;*
Figure 7A:
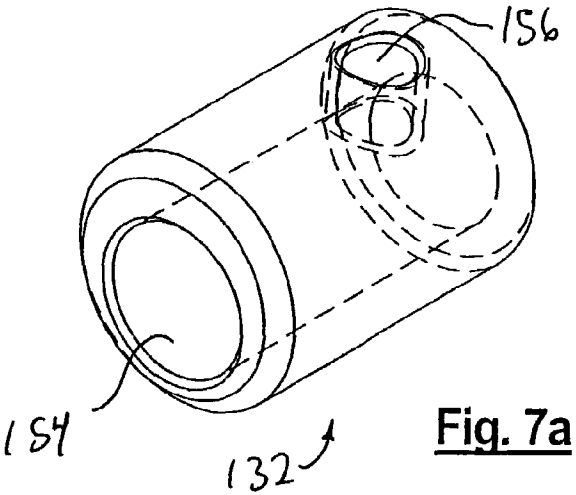
FIG. 7*a*-7*d* are views of the eccentric of FIG. 6.
Figure 7B:
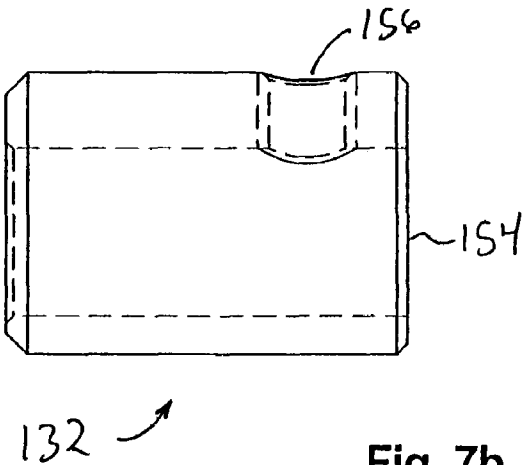
Figure 7D:
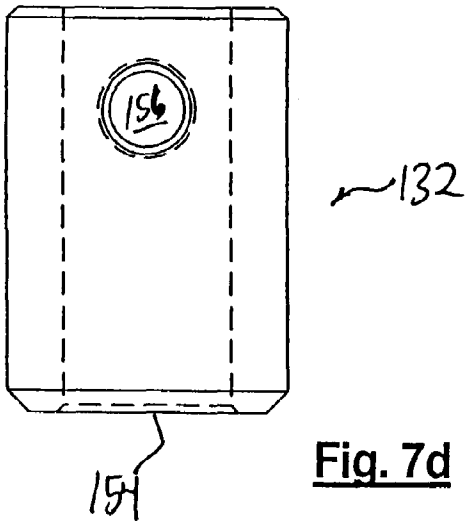
Figure 7C:
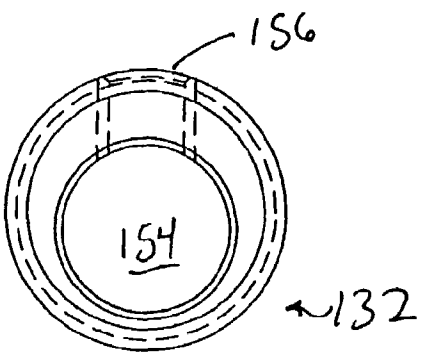
Figure 8B:
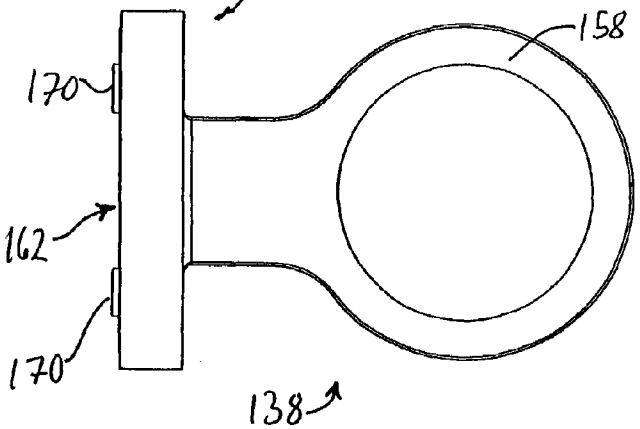
FIG. 8*a*-8*d* are views of the piston of FIG. 6.
Figure 8D:
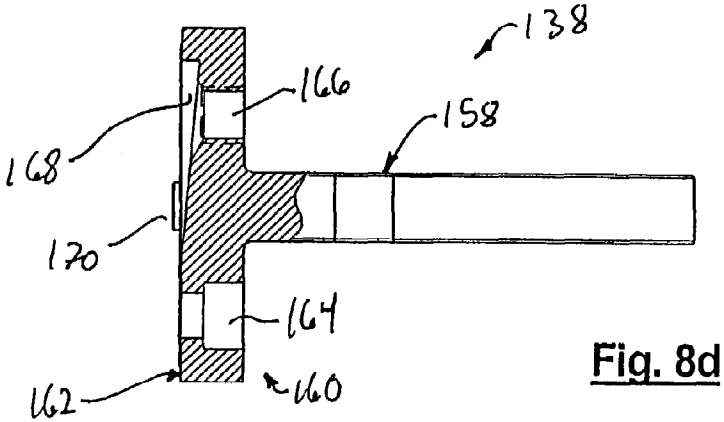
Figure 8A:
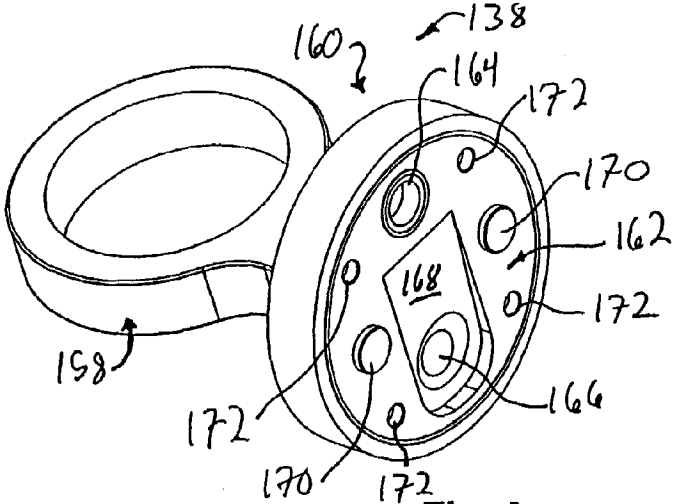
Figure 8C:
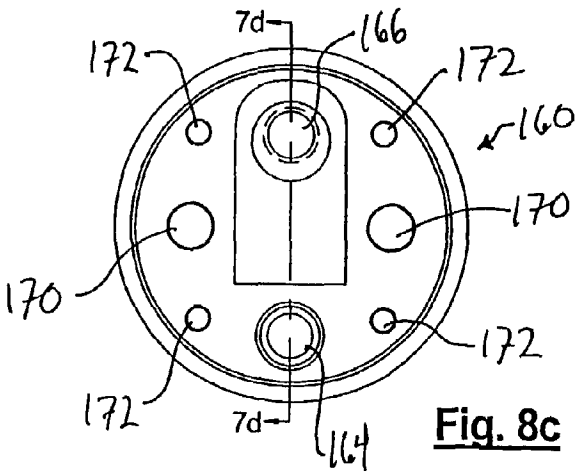

Since the piston assembly for each of the compressor head 104 and the second compressor head 106 is substantially identical, only one piston assembly will be described. The piston assembly 130 is shown in FIG. 6 and includes an eccentric core 132 and a set screw 134, a bearing 136, a piston 138, an intake barb 140, an intake resonator tube 142, an output barb 144, a piston seal 146, and a retaining plate 148 with an intake flapper 150 and an output flapper 152.

Referring to FIGS. 7*a*-7*d*, the eccentric core 132 is substantially cylindrical and includes a through hole 154 and a tapped bore 156 having an axis that is perpendicular to the axis of the through hole 154. The eccentric core 132 is coupled to the central bore of the bearing 136. The through hole 154 is non-concentric with the outer surface of the eccentric core 132. The through hole 154 is configured for a clearance fit with the drive shaft 108 and the tapped bore 156 is configured for receiving the set screw 134, which engages the drive shaft 108 to retain it within the eccentric core 132.

Referring now to FIGS. 8*a*-8*d*, the piston 138 is preferably made of a rigid, heat dissipating material and includes a bearing receptacle 158 and a piston head 160. The bearing receptacle 158 is configured for coupling the bearing 136. The piston head 160 is preferably integral with the bearing receptacle 158 and includes a valve face 162, an intake barb receiver 164, and an output barb receiver 166. The valve face 162 includes an indentation 168, two protuberances 170, and four blind bores 172. The intake barb receiver 164 is a through hole configured for connection with the intake barb 140. The output barb receiver 166 is configured for engaging the output barb 144. The indentation 168 provides clearance for the output flapper 152.

Figure 9B:
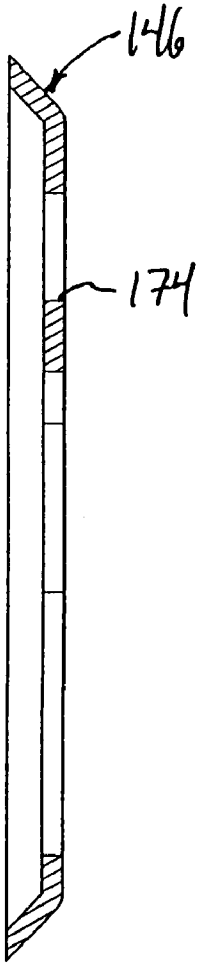
FIGS. 9*a* and 9*b* are views of the piston seal of FIG. 6.
Figure 9A:
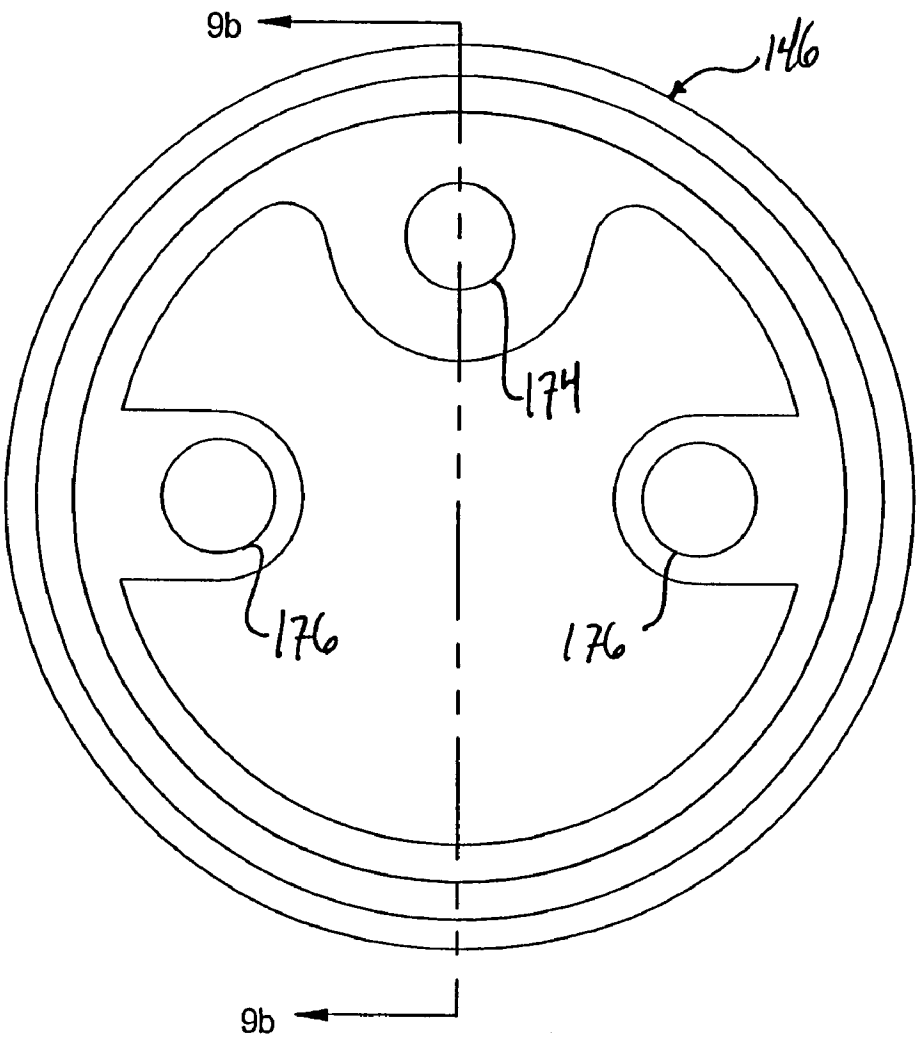

As shown in FIGS. 9*a* and 9*b*, the piston seal 146 is substantially ring-shaped and includes air inlet passage 174 and retaining rings 176. As shown in FIG. 6, the air inlet passage 174 lines up with the intake barb receiver 164 and the retaining rings 176 slide over the two protuberances 170.

Figure 10:
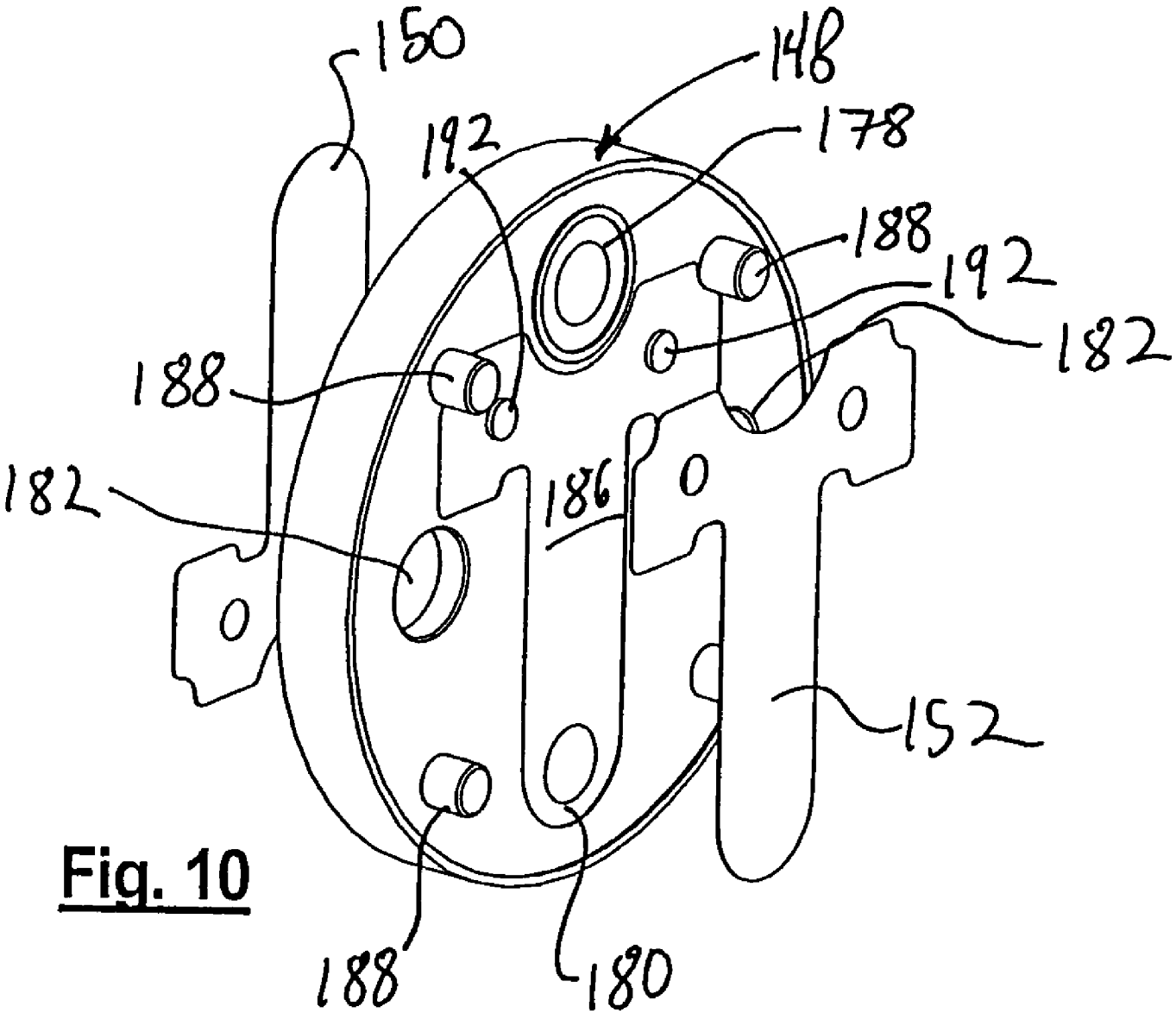
FIG. 10 is an isometric view of the retaining plate of FIG. 6.

FIG. 10 shows the retaining plate 148 with the intake flapper 150 and the output flapper 152. The retaining plate 148 includes an intake bore 178, an output bore 180, clearance bores 182, an intake flapper recess 184 (shown in FIG. 6), an output flapper recess 186 and pegs 188. The clearance bores 182 line up with the protuberances 170 when the piston assembly 130 is assembled in order to provide space for the protuberances 170. The intake flapper 150 and the output flapper 152 are preferably made of spring steel. The intake flapper recess 184 and the output flapper recess 186 have polished surfaces proximate to the intake bore 178 and the output bore 180, respectively. The intake flapper 150 fits into the intake flapper recess 184 such that it is flush with the surface of the retaining plate 148. Intake flapper plate posts 190 line up with holes in the intake flapper 150. The intake flapper plate posts 190 are peened to thereby retain the intake flapper 150 in the intake flapper recess 184. Similarly, the output flapper 152 fits into the output flapper recess 186 such the it is flush with the surface of the retaining plate 148. Output flapper plate posts 192 line up with holes in the output flapper 152. The output flapper plate posts 192 are peened to thereby retain the output flapper 152 in the output flapper recess 186. The intake flapper 150 and the output flapper 152 are further retained by adhesive applied to the end of the flappers proximate to the respective input flapper plate posts 190 and output flapper plate posts 192. The pegs 188 are configured for engaging the blind bores 172 (shown in FIG. 8*a*).

The intake bore 178 may include a beveled edge on the side of the retaining plate 148 that is opposite to the intake flapper 150 to improve the efficiency of the air flow through the intake bore 178. Similarly, the output bore 180 may include a beveled edge on the side of the retaining plate 148 that is opposite to the output flapper 152 to improve the efficiency of the air flow through the output bore 180. An O-ring or coating may be included as the interface between the intake flapper 150 and the intake bore 178. Similarly, an O-ring or coating may be included as the interface between the output flapper 152 and the output bore 180. Multiple intake and output holes and flappers may be used such as in the case that there are multiple, isolated flow systems.

The assembly of the piston assembly is shown in FIG. 6. The eccentric core 132 is press fit or otherwise coupled to the inner surface of the bearing 136. The bearing 136 is press fit or otherwise coupled to the inner surface of the bearing receptacle 158. The intake barb 140 is press fit or screwed into the intake barb receiver 164 and the intake resonator tube 142 engages the intake barb 140. The intake resonator tube 142 cooperates with the chamber formed by the compressor housing cover 114 and compressor housing 116, 118 to act as an intake resonator. The output barb 144 is press fit or screwed into the output barb receiver 166 and a flexible output tube (not shown) connects the output barb 144 to the corresponding output port 128*a*, 128*b*. The piston seal 146 is assembled to the piston head 160 by lining up the air inlet passage 174 with the intake barb receiver 164 and sliding the retaining rings 176 over the two protuberances 170. The pegs 188 are press fit into the blind bores 172 to assemble the retaining plate 148 to the piston head 160.

Figure 12:
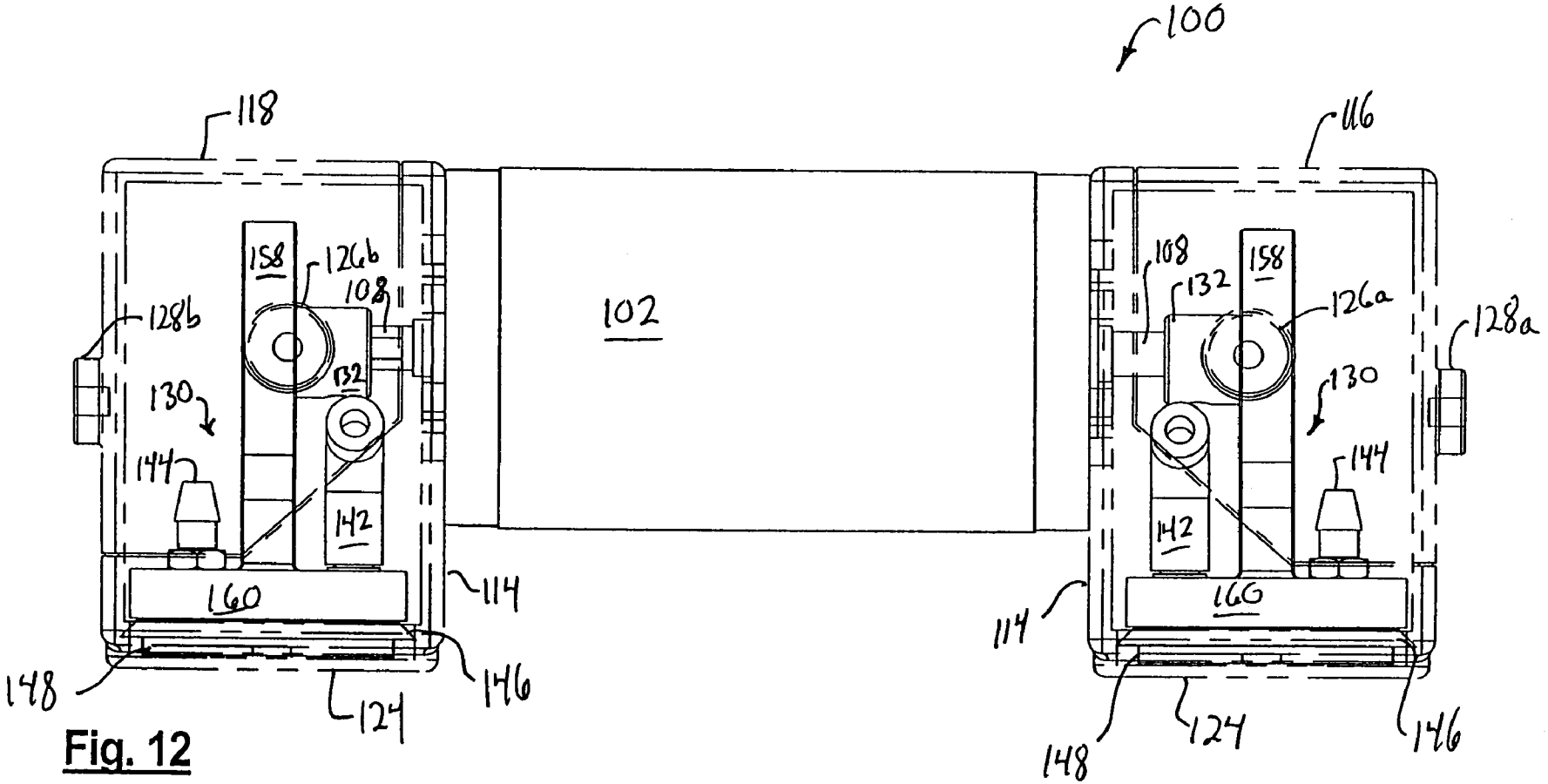
FIG. 12 is a top view of the assembled compressor of FIG. 1*a* with the housings in phantom to show the piston assemblies.

The eccentric core 132 slides onto the drive shaft 108 (shown in FIG. 2) and the set screw 134 is screwed into the tapped bore 156 until the set screw 134 engages the drive shaft 108 and retains it within the eccentric core 132. The piston assembly 130 is shown in FIGS. 11*a*-11*c*. The assembled dual head compressor 100 is shown in FIG. 12 with housing covers 114 and housings 116, 118 in phantom. FIG. 12 shows how the piston heads 130 fit within the housings and how the retaining plates 148 and the piston seals 146 fit within the compressor cylinders 124.

Figure 13B:
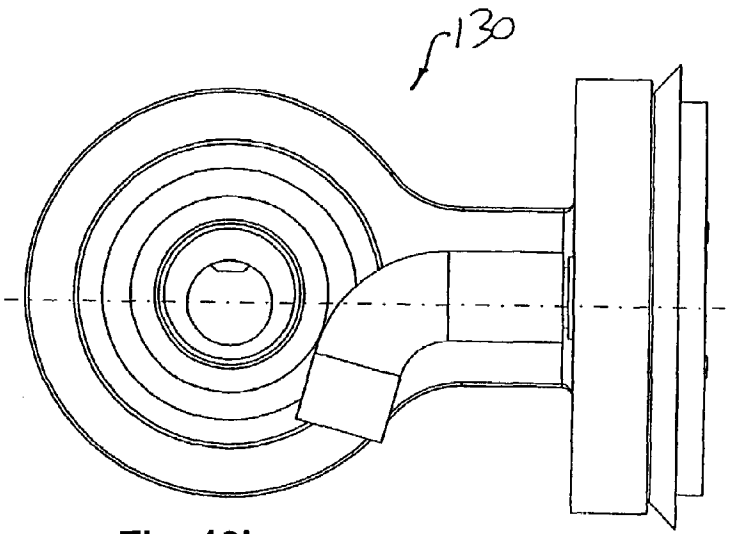
FIGS. 13*a*-13*d* show the position of the piston assembly as the eccentric core is rotated by about 90 degrees for each subsequent view.
Figure 13A:
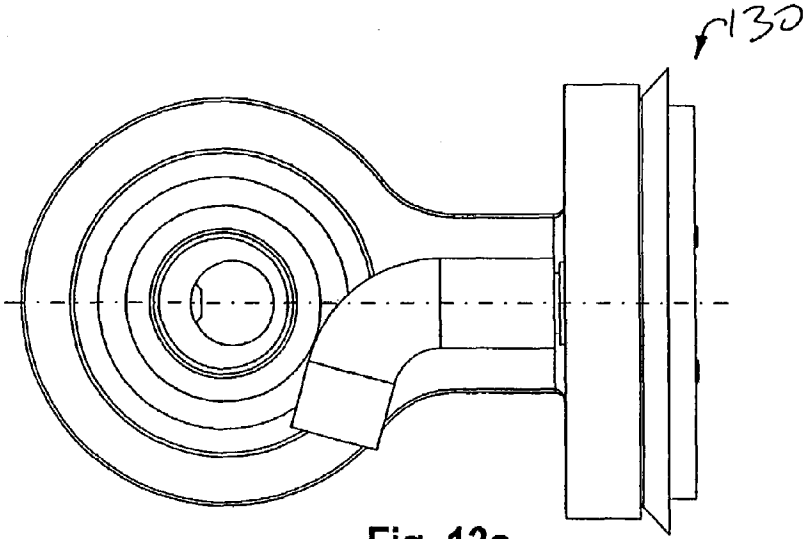
Figure 13D:
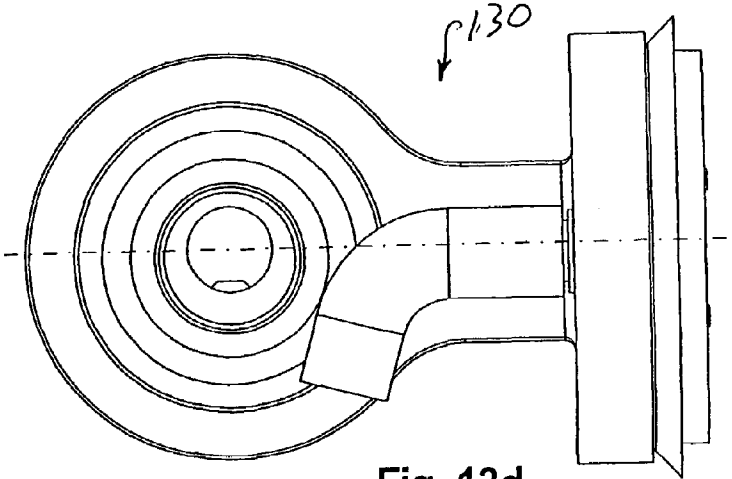
Figure 13C:
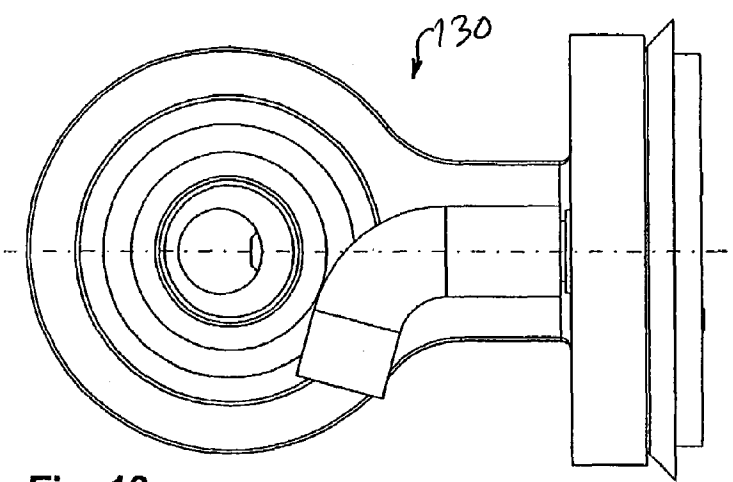

In use, the rotating drive shaft 108 turns the eccentric core 132 as best shown in FIGS. 13*a*-13*d*. FIG. 13*a* shows the piston assembly 130 in the fully retracted position in this position, the compressor cylinder 124 contains a quantity of gas to be compressed and the piston seal 146 forms a seal between the retaining plate 148 and the inner surface of the compressor cylinder 124. As the eccentric core 132 is rotated 90 degrees within the bearing 136 by the drive shaft 108, the piston assembly 130 pivots slightly as shown in FIG. 13*b* while traveling toward the fully inserted position. The gas within the compressor cylinder 124 is now being compressed and thus places pressure on the intake flapper 150 and the output flapper 152 via the output bore 180 of the retaining plate 148. This pressure causes intake flapper 150 to close off the intake bore 178 and forces the output flapper 152 to bend into the indentation 168 in the piston head 160. Thus, the output bore 180 is open to allow the gas to pass through the indentation 168 and the output barb 144. FIG. 13*c* shows the piston assembly 130 in the fully inserted position, after another 90 degree rotation of the eccentric core 132, where the gas is no longer being compressed. Any back pressure in the output barb 144 causes the output flapper 152 to close the output bore 180 off and prevents the gas from flowing back into the compressor cylinder 124 via the output bore 180. As the eccentric core 132 is rotated another 90 degrees through the intermediate position shown in FIG. 13*d* back to the fully retracted position shown in FIG. 13*a*, the piston assembly again pivots slightly. The negative pressure in the compressor cylinder 124 caused by the retracting piston assembly 130 forces the intake flapper 150 to bend outward thus opening the intake bore 178 in the retaining plate 148. Gas in the chamber formed by the compressor housing cover 114 and compressor housings 116, 118 flows through the intake resonator tube 142, the intake barb 140, and the intake bore 178 into the compressor cylinder 124. The gas enters the chamber through the intake port 126*a*, 126*b*. The piston assembly 130 is thus repeatedly cycled through the compression and retraction strokes to provide pressurized gas. The direction of rotation of the eccentric core 132 shown in the sequence of FIGS. 13*a*-13*b* is arbitrary.

Because the valves are incorporated into the piston head 160, the compressor advantageously is quite compact. Also, by forming the intake resonator in cooperation of the intake resonator tube 142 and the housing, a large device located outside the compressor as is conventionally used is not needed. A further advantage results from metal to metal contact between the piston and the valves—the protuberances 170 on the piston head 160 contact the clearance bores 182 in the retaining plate 148—thus providing better heat dissipation between the valves and the piston than in conventional compressors. Even further, the compressor cylinder 124, including the end cap of the cylinder, being of one piece of metal integral with the housing cover 114 and thus the full surface of the cylinder, the housing dissipates heat generated by the compressor. There are no rubber seals to isolate parts of the compressor cylinder 124, and the mass of the valves does not impede heat transfer.

The inclusion of the surface area of the cylinder end cap in the cylinder's cooling area significantly increases the cooling efficiency of the cylinder. For example, for a cylinder with a stroke length of 0.057-in and a diameter of 2.9-in, the addition of the end cap area for heat dissipation can lead to approximately 6 times the cooling area and a temperature decrease of approximately 20° C., resulting in a 123% increase in the life of the cup seal. Yet, a significant advantage of the present invention is that it is more compact than conventional compressors.

It should be noted that the means of assembly of the compressor parts as described is by way of example only. Alternatives to the means of mechanical assembly may be employed, such as adhesives and brazing.

Figure 14:
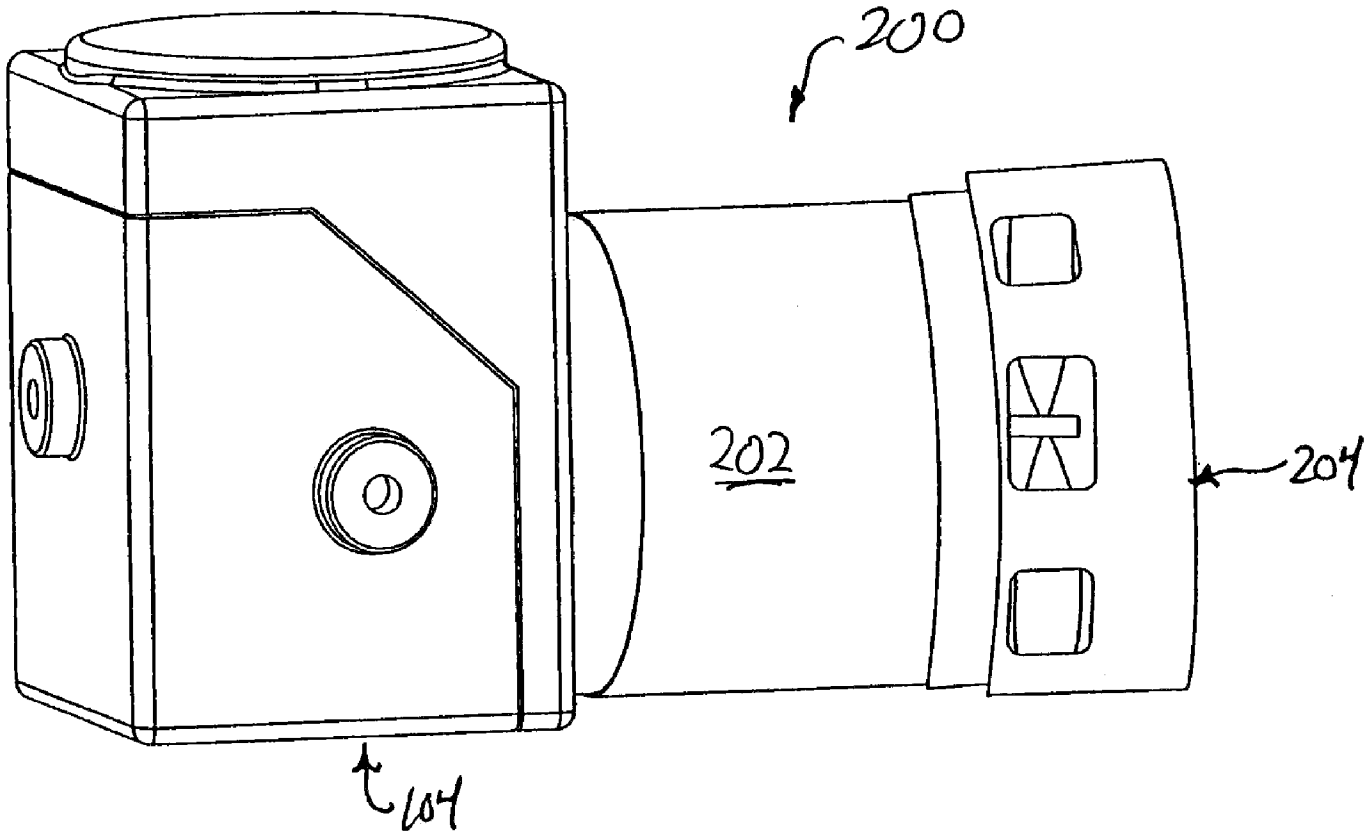
FIG. 14 is an isometric view of a modification of the first embodiment with a single head compressor.

It should be particularly noted that the present invention may be applied to a dual head or a single head compressor. A single head compressor 200 as shown in FIG. 14, has a significantly smaller motor 202 and may include a cooling fan and fan guard 204 or other device on the opposite drive shaft. In certain applications such as the air supply of an oxygen concentrator, a single head compressor is generally sufficient for about a 0.5 liter unit and a dual head compressor is generally useful for about a 1 liter unit.

If appropriate to maintain balance or reduce vibration, a counter weight may be included with the piston assembly 130. In this case, the drive shaft 108 extends through the eccentric core 132 to protrude out the opposite side of the core. The counter weight is situated on the protruding drive shaft 108 such that the counter weight has more weight on the side of the shaft that is opposite to that of the lobe of the eccentric core.

In the first embodiment, the dual head compact compressor is configured such that both compressor heads output pressurized gas to the supply side of a gas handling system in an alternating manner. More particularly, while one compressor head is in its compression stroke, and thus is supplying pressurized gas to the gas supply, the opposite compressor head is in its draw stroke. In an alternate configuration of a dual head compressor, one compressor head may be configured to supply compressed gas to the supply side of a gas handling system while the second compressor is configured to act as a vacuum drawing gas from the output side of the gas handling system or in an intermediate point within the gas handling system. In a further alternate configuration, the dual head compact compressor includes a single, elongated drive shaft and two or more compressor heads are driven by that shaft. In an even further alternate configuration, larger intake and output flappers such as a disk or a ring may be used. One of the flappers in a piston head is mounted on the retaining plate while the corresponding flapper is mounted to a discharge plate. The following embodiment illustrates all of these alternate configurations. It should be noted that the features described in the following embodiment may be combined with features described in the previous embodiments.

Figure 15A:
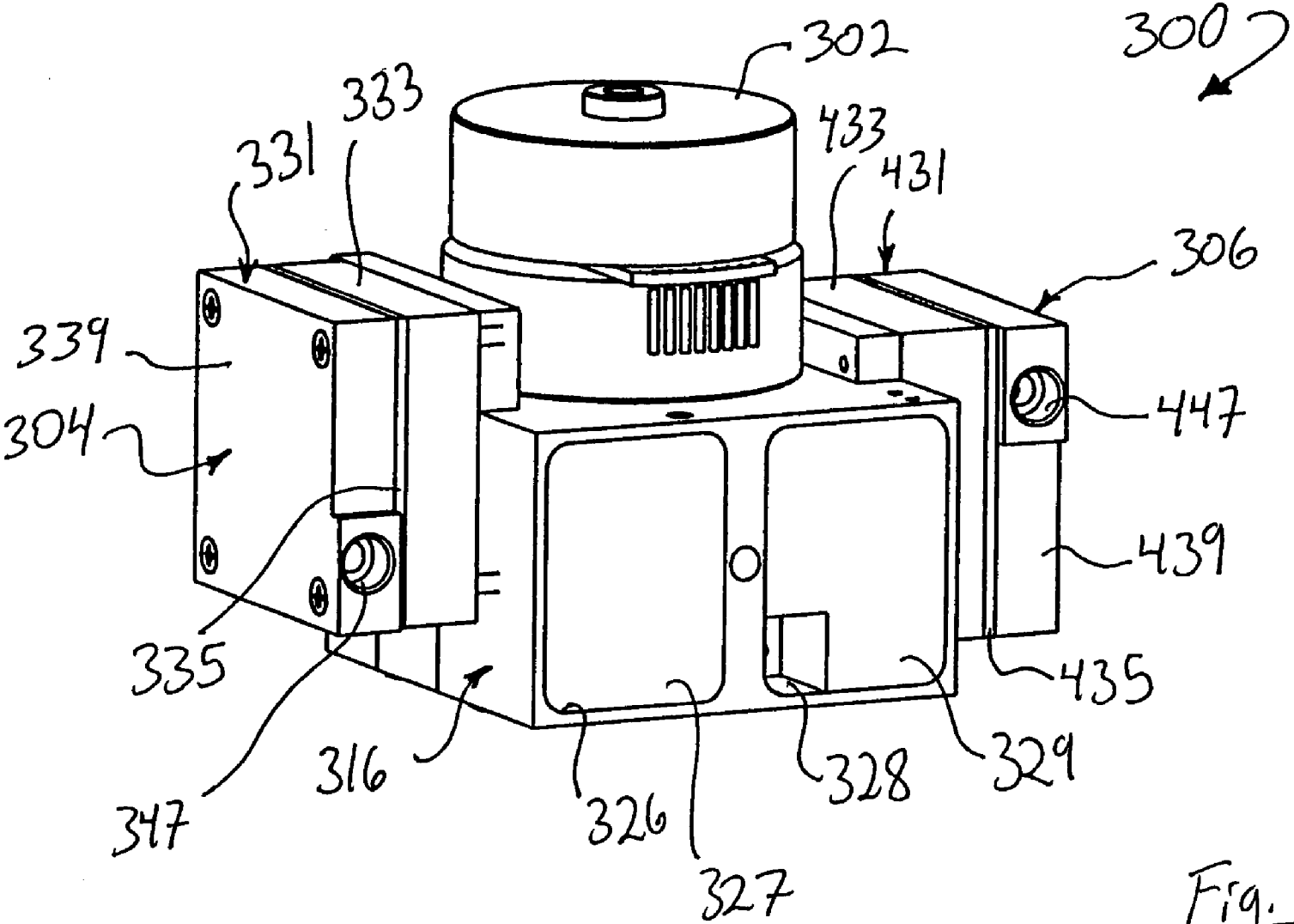
FIGS. 15*a* and 15*b* illustrate a second embodiment of a double-headed compressor of the present invention.

The compact compressor 300 of a second embodiment is shown in FIG. 15*a* and includes a single-shaft motor 302, a central housing 316, a pressure-side compressor head 304, and a vacuum-side compressor head 306.

Figure 15B:
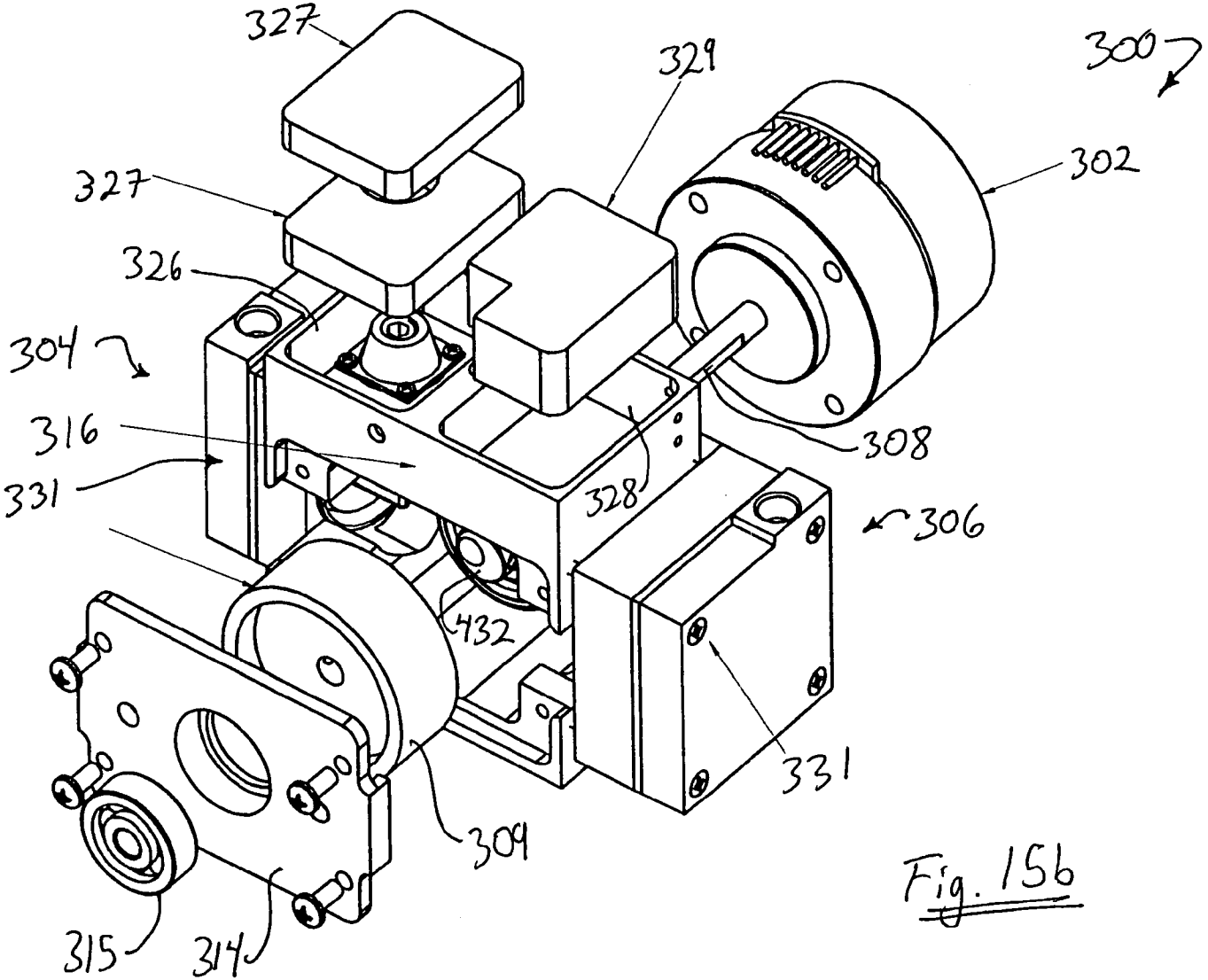

The motor 302 is a standard electric motor with a single drive shaft 308, shown in FIG. 15*b*, and is securely mounted to the central housing 316 with the drive shaft 308 penetrating the central housing 316. The central housing 316 is configured to support both compressor heads 304, 306 and includes an inlet chamber 326 with inlet filters 327, an outlet chamber 328 with outlet filters 329, a counterweight 309, a drive shaft support plate 314, and a drive shaft support bearing 315. Depending on the function and the gases to be moved, one of the compressor heads 304, 306 may have a longer stroke and therefore have a larger eccentric core. Also, the peaks of the eccentric cores need not necessarily be 180° from one another. The counterweight 309 is configured to even out the weight distribution on the drive shaft 308 to thereby reduce vibration of the drive shaft 308. The drive shaft support plate 314 closes the central housing 316 and supports the drive shaft support bearing 315, which supports the free end of the drive shaft 308. Some motors and configurations may not require the added support of the drive shaft support bearing 315.

Figure 16A:
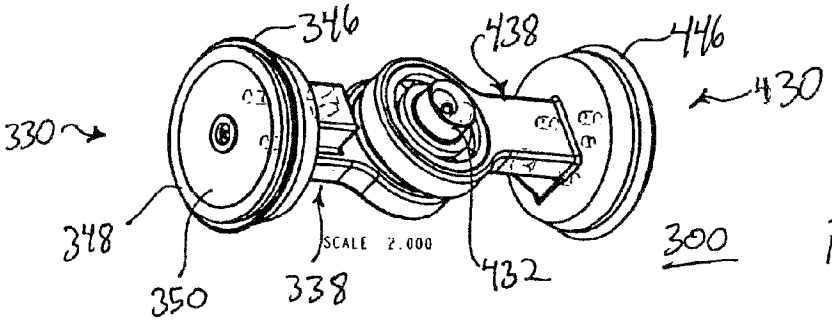
FIGS. 16*a*-16*c* are several views of the piston assemblies of the compressor of FIG. 15*a*.
Figure 16B:
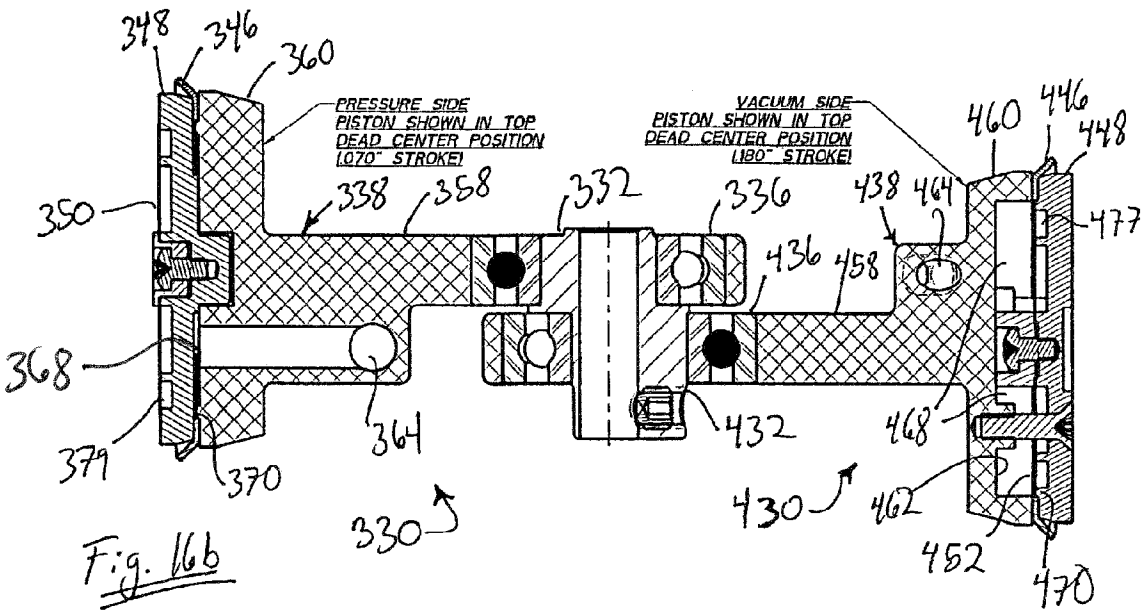
Figure 16C:
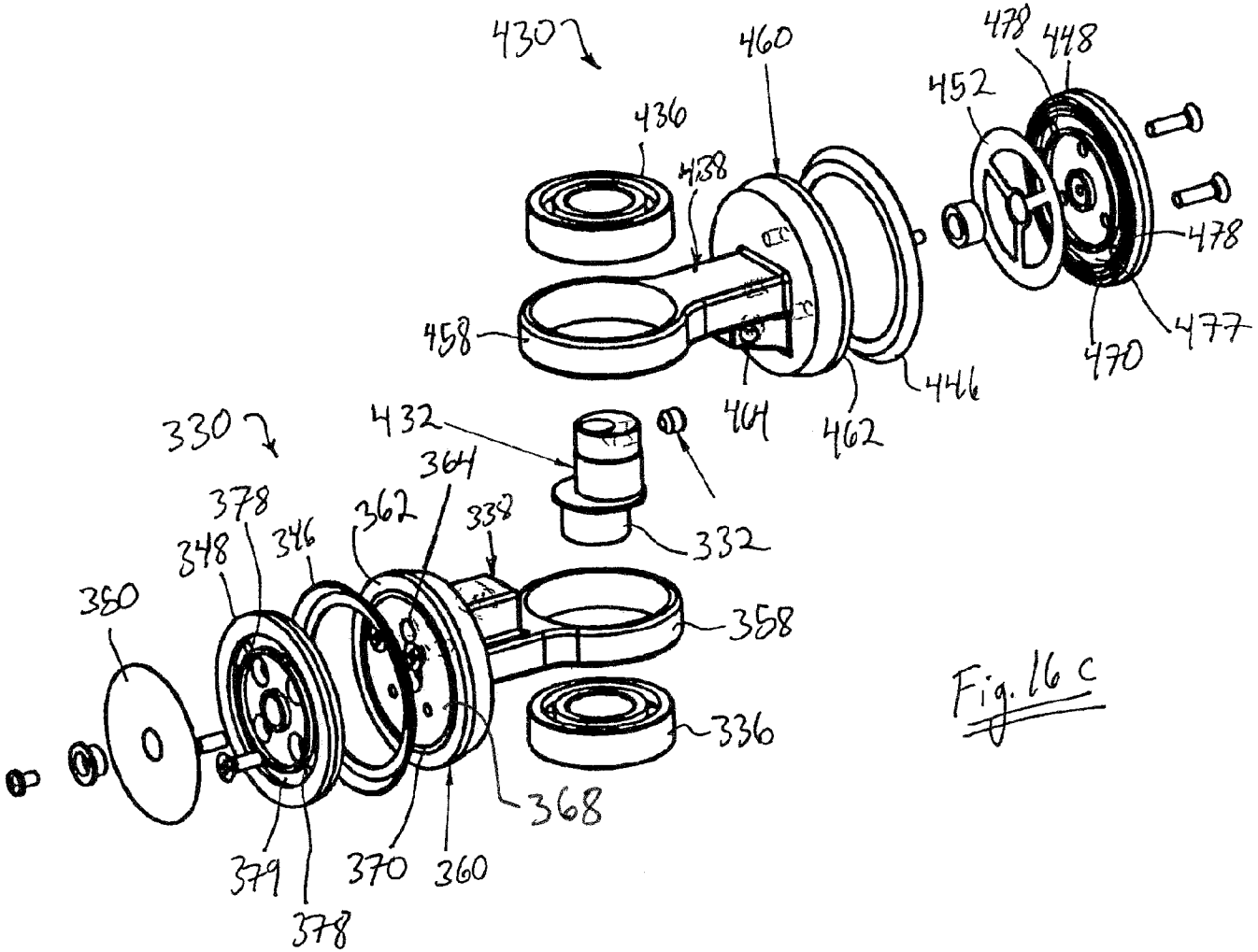

FIGS. 16*a*-16*c* illustrate an example in which one compressor head supplies pressure and the other compressor head supplies a vacuum although either or both could provide the same or a different function depending on head dimensions. As shown, the pressure-side compressor head 304 includes a pressure-side piston assembly 330 and a pressure-side chamber assembly 331. The pressure-side piston assembly 330 is shown in FIGS. 16*a*-16*c* and includes a pressure-side eccentric core 332, a bearing 336, a pressure-side piston 338, a piston seal 346, a pressure-side retaining plate 348, and a pressure-side intake flapper 350. The pressure-side eccentric core 332 is configured similarly to the eccentric core 132 described above. Further, the pressure-side eccentric core 332 is mounted onto the drive shaft 308 similarly to how the eccentric core 132 is mounted onto the drive shaft 108. The bearing 336 is configured to engage the pressure-side eccentric core 332.

The pressure-side piston 338 includes a bearing receptacle 358 and a pressure-side piston head 360. The bearing receptacle 358 is configured for coupling to the bearing 336. The pressure-side piston head 360 includes a pressure-side valve face 362, and a pressure-side intake passage 364. The pressure-side valve face 362 includes a piston seal guide 370 and a recess 368. The piston seal 346 sits on the pressure-side valve face 362 around the piston seal guide 370. The pressure-side retaining plate 348 includes intake bores 378 and a track 379. The pressure-side retaining plate 348 is mounted onto the pressure-side valve face 362 by mechanical fasteners or other suitable means such that the piston seal 346 is trapped between the pressure-side valve face 362 and the pressure-side retaining plate 348. The recess 368 forms a chamber between the pressure-side valve face 362 and the pressure-side retaining plate 348 that is in fluid communication with the pressure-side intake passage 364 and the intake bores 378. The track 379 forms a chamber between the pressure-side intake flapper 350 and the pressure-side retaining plate 348 and is in fluid communication with the intake bores 378. The pressure-side intake flapper 350 is affixed to the pressure-side retaining plate 348 by mechanical fasteners or other suitable means such that the pressure-side intake flapper 350 normally covers the second track 379 and the outer circumference of the pressure-side intake flapper 350 may bend away from the pressure-side retainer plate 348. A pressure-side intake tube 342 puts the pressure-side intake passage 364 in fluid communication with the inlet chamber 326.

Figure 17:
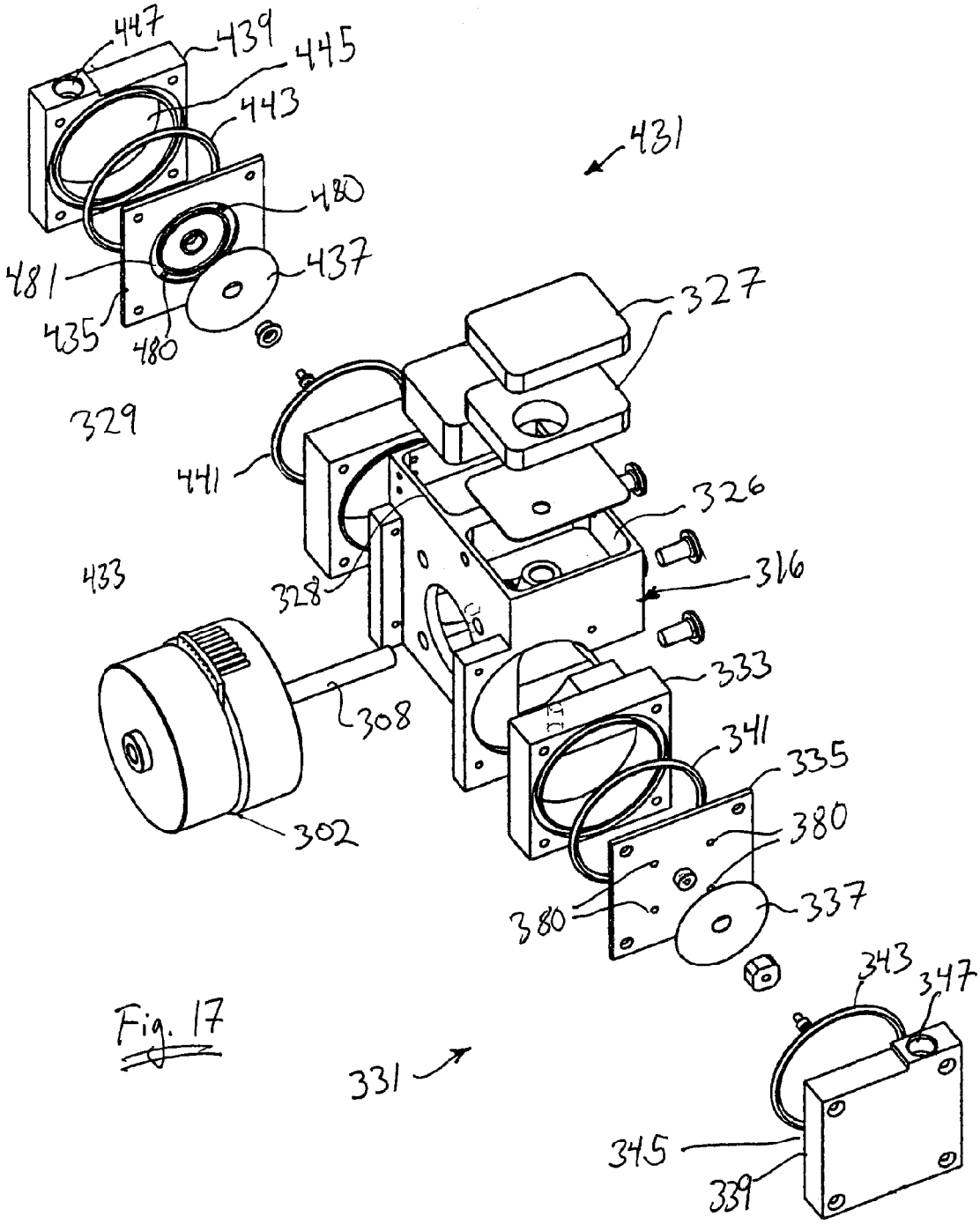
FIG. 17 is an exploded view of the chamber components of the compressor of FIG. 15*a*.

The pressure-side chamber assembly 331 is best shown in FIG. 17 and includes a cylinder head 333, a pressure-side discharge plate 335, a pressure-side output flapper 337, and an end-cap 339. The cylinder head 333 is mounted to the central housing 316 and the inner surface of the cylinder head 333 is configured to squeeze the piston seal 346 such that the piston seal 346 forms a seal around the entire inner circumference of the cylinder head 333. A cylinder head O-ring 341 is installed in an O-ring track in the cylinder head 333. The pressure-side discharge plate 335 includes output bores 380. The pressure-side discharge plate 335 is mounted onto the cylinder head 333 such that a seal is formed between the cylinder head O-ring 341 and the pressure-side discharge plate 335. The pressure-side output flapper 337 is mounted onto the discharge plate 333 such that the output bores 380 are covered and the outer circumference of the pressure-side output flapper 337 may bend away from the pressure-side discharge plate 335. An end-cap O-ring 343 is installed in an O-ring track in the end-cap 339, which is mounted to the pressure-side discharge plate 335 such that a seal is formed between the end-cap 339 and the discharge plate 335. The end-cap 339 includes an end-cap chamber 345 that provides space for the pressure-side output flapper 337 to bend away from the pressure-side discharge plate 335 and is in fluid communication with a pressure-side output passage 347.

The vacuum-side compressor head 306, shown in FIG. 15*a*, includes a vacuum-side piston assembly 430 and a vacuum-side chamber assembly 431. The vacuum-side piston assembly 430 also is shown in FIGS. 16*a*-16*c* and includes a vacuum-side eccentric core 432, a bearing 436, a vacuum-side piston 438, a piston seal 446, a vacuum-side output flapper 452, and a vacuum-side retaining plate 448. The vacuum-side eccentric core 432 is affixed to or integral with the eccentric core 332 described above. The vacuum-side eccentric core 432 may have a different radius than the pressure-side eccentric core 332 such that the vacuum-side piston assembly 430 has a longer or shorter stroke than the pressure-side piston assembly 330. Further, the vacuum-side eccentric core 432 may have a different phase than the pressure-side eccentric core 332. For example, the vacuum-side eccentric core 432 is shown in FIGS. 16*b* and 16*c* as being phased about 180° from the pressure-side eccentric core 332 such that the vacuum-side piston assembly 430 is at the top dead center position when the pressure-side piston assembly 330 is also at the top dead center position. The bearing 436 is configured to engage the vacuum-side eccentric core 432.

The vacuum-side piston 438 includes a bearing receptacle 458 and a vacuum-side piston head 460. The bearing receptacle 458 is configured for coupling to the bearing 436. The vacuum-side piston head 460 includes a vacuum-side valve face 462, and a vacuum-side output passage 464. The vacuum-side valve face 462 includes a recess 468 that is in fluid communication with the vacuum-side output passage 464. The vacuum-side retaining plate 448 includes a piston seal guide 470, a track 477, and intake bores 478. The piston seal 446 sits on the vacuum-side retaining plate 448 around the piston seal guide 470. The vacuum-side output flapper 452 is affixed to the vacuum-side retaining plate 448 such that the vacuum-side output flapper 452 normally covers the track 477 and the outer circumference of the vacuum-side output flapper 452 may bend away from the vacuum-side retainer plate 448 into the recess 468. The vacuum-side retaining plate 448 is mounted onto the vacuum-side valve face 462 by such that the piston seal 446 is trapped between the vacuum-side valve face 462 and the vacuum-side retaining plate 448. The recess 468 forms a chamber between the vacuum-side output flapper 452 and the vacuum-side valve face 462. The track 477 forms a chamber between the vacuum-side output flapper 452 and the vacuum-side retaining plate 448 and is in fluid communication with the intake bores 478. A vacuum-side output tube 442 puts the vacuum-side output passage 464 in fluid communication with the outlet chamber 328.

The vacuum-side chamber assembly 431 is best shown in FIG. 17 and includes a cylinder head 433, a vacuum-side intake flapper 437, a vacuum-side discharge plate 435, and an end-cap 439. The cylinder head 433 is mounted to the central housing 316 and the inner surface of the cylinder head 433 is configured to squeeze the piston seal 446 such that the piston seal 446 forms a seal around the entire inner circumference of the cylinder head 433. A cylinder head O-ring 441 is installed in an O-ring track in the cylinder head 433. The vacuum-side intake flapper 437 is mounted onto the discharge plate 433 such that the outer circumference of the vacuum-side intake flapper 437 may bend away from the vacuum-side discharge plate 435. The vacuum-side discharge plate 435 includes intake bores 480 and a track 481 in fluid communication with the intake bores 480. The track 481 forms a chamber between the vacuum-side discharge plate 435 and the vacuum-side intake flapper 437. The vacuum-side discharge plate 435 is mounted onto the cylinder head 433 such that a seal is formed between the cylinder head O-ring 441 and the vacuum-side discharge plate 435. An end-cap O-ring 443 is installed in an O-ring track in the end-cap 439, which is mounted to the vacuum-side discharge plate 435 such that a seal is formed between the end-cap 439 and the discharge plate 435. The end-cap 439 includes an end-cap chamber 445 that is in fluid communication with a vacuum-side intake passage 447.

In use, the motor 302 rotates the drive shaft 308 causing the pressure-side piston assembly 330 and the vacuum-side piston assembly to travel from the top dead center position to the bottom dead center position. The resulting negative pressure in the cylinder head 333 pulls the pressure-side output flapper 337 against the pressure-side discharge plate 335 closing the output bores 380. The negative pressure also forces the pressure-side intake flapper off of the pressure-side retaining plate 348 to thereby allow gas to flow through pressure-side intake passage 364 and the intake bores 378 into the cylinder head 333. The resulting negative pressure in the cylinder head 433 pulls the vacuum-side output flapper 452 against the vacuum-side retainer plate 448 thereby closing the track 477 and output bores 478. The negative pressure also forces the vacuum-side intake flapper 437 off of the vacuum-side discharge plate 435 such that gas is drawn into through the vacuum-side intake passage 447 and intake bores 480 into the cylinder head 433.

As the motor 302 continues to rotate the drive shaft 308, the pressure-side piston assembly 330 and the vacuum-side piston assembly 430 travel from the bottom dead center position to the top dead center position. The resulting positive pressure in the cylinder head 333 causes the pressure-side intake flapper 350 to close the track 379 and thus the intake bores 378. The positive pressure also forces the pressure-side output flapper 337 off of the pressure-side discharge plate 335 to thereby open the output bores 380 as the gas is forced from the cylinder head 333 through the output bores 380, into the end-cap chamber 345 and through the pressure-side output passage 347. The resulting positive pressure in the cylinder head 433 causes the vacuum-side intake flapper 437 to close the track 481 and thus the intake bores 380. The positive pressure also forces the vacuum-side output flapper 452 off of the track 477 thereby opening the output bores 478 as the gas if forced from the cylinder head 433, through the output bores 478, into the recess 468, and through the vacuum-side output passage 464. The cycle repeats as the motor 302 continues to rotate the drive shaft 308.

Depending on the use(s) of the compressor, the phase angles of the pistons can be varied from that shown.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

The invention claimed is:

1. A compact gas compressor, comprising:
- a compression cylinder having a closed end and an open end;
- a piston having a piston head disposed proximate to the open end of said compression cylinder;
- a flapper valve assembly affixed to the piston head of said piston such that said flapper valve assembly is disposed within said compression cylinder;
- a seal disposed between said flapper valve assembly and the piston head, said seal forming a gas-tight seal on the open end of said compression cylinder;
- an intake barb penetrating the piston head of said piston; and
- an intake resonator tube engaging said intake barb.

2. The compressor of claim 1, further comprising a second compression cylinder, a second piston, and a second flapper assembly, the first piston and the second piston being driven by a motor.

3. The compressor of claim 2, the motor having two drive shafts, the first piston cooperating with one drive shad via a first eccentric core and the second piston cooperating with the other drive shaft via a second eccentric core.

4. The compressor of claim 1, wherein the piston head comprises protuberances that contact the valve assembly to provide metal-to-metal contact for heat distribution.

5. A compact gas compressor, comprising
- a compressor housing having a resonating chamber and an integral compression cylinder;
- a motor affixed to a side of said compressor housing, said motor having a drive shaft penetrating the side of said compressor housing into the resonating chamber;
- a piston having a portion engaging the drive shaft and a piston head located within the compression cylinder, the piston head comprising:
  - a flapper valve assembly having an intake flapper valve and an output flapper valve;
  - a cup seal forming a seal between the piston head and the compression cylinder; and
- an intake resonator tube having a first end in fluid communication with the intake flapper valve of said flapper valve assembly and a second end disposed within the resonating chamber of said compressor housing such that the resonating chamber and said intake resonator tube cooperate to function as an intake resonator.

6. The compact gas compressor of claim 5, further comprising an eccentric core located between the drive shaft of said motor and the drive shaft engaging portion of said piston.

7. A compact gas compressor, comprising
- a compressor housing having a resonating chamber and an integral compression cylinder;
- a motor affixed to a side of said compressor housing, said motor having a drive shaft penetrating the side of said compressor housing into the resonating chamber;
- a piston having a portion engaging the drive shaft and a piston head located within the compression cylinder, the piston head comprising:
  - a flapper valve assembly having an intake flapper valve and an output flapper valve;
  - a cup seal forming a seal between the piston head and the compression cylinder; and
- a fan and a second drive shaft on the motor causing the fan to direct air flow to said compressor housing.

8. A compact gas compressor, comprising:
- a compressor housing having an intake chamber and a compression cylinder;
- a motor affixed to a side of said compressor housing, said motor having a drive shaft penetrating the side of said compressor housing into a chamber that is in direct fluid communication with the intake chamber; and
- a piston having a portion engaging the drive shaft and a piston head located within the compression cylinder, the piston head comprising:
  - a valve face;
  - a flapper valve assembly having a flapper valve positioned on a retaining plate that engages the valve face;
  - a cup seal forming a seal between the piston head and the compression cylinder, the cup seal comprising means positioned between the retaining plate and the valve face for retaining the cup seal in place; and
- a second piston cooperating with a second compression cylinder.

9. The compressor of claim 8, further comprising an eccentric core disposed on a drive shaft extending from the motor, the eccentric core having a first portion cooperating with the first piston and a second portion cooperating with the second piston.

10. The compressor of claim 9, the compressor housing comprising a central housing that supports said compression cylinders and said motor.

11. The compressor of claim 9, the first portion of the eccentric core being substantially 180 degrees out of phase with the second portion of the eccentric core.

* * * * *